US005092749A

United States Patent [19]

Meijer

[11] Patent Number: 5,092,749

[45] Date of Patent: Mar. 3, 1992

[54] FLUID PUMP DRIVE MECHANISM

[75] Inventor: Robert S. Meijer, San Diego, Calif.

[73] Assignee: Imed Corporation, San Diego, Calif.

[21] Appl. No.: 519,835

[22] Filed: May 7, 1990

[51] Int. Cl.[5] ..... F04B 43/12

[52] U.S. Cl. ..... 417/474; 417/479; 74/53; 74/106

[58] Field of Search ..... 417/474, 478, 479; 92/140; 74/106, 520, 37, 53

[56] References Cited

U.S. PATENT DOCUMENTS

| | | | |
|---|---|---|---|
| 1,480,256 | 1/1924 | Gates | 417/474 |
| 3,205,803 | 3/1962 | Swarthout | 74/53 |
| 3,778,195 | 12/1973 | Bamberg | 417/474 |
| 4,236,880 | 12/1980 | Archibald | 417/478 |
| 4,410,322 | 10/1983 | Archibald | 604/153 |
| 4,482,347 | 11/1984 | Borsanyi | 604/153 |
| 4,561,830 | 12/1985 | Bradley | 417/474 |

FOREIGN PATENT DOCUMENTS

| | | | |
|---|---|---|---|
| 611566 | 10/1926 | France | 74/53 |

*Primary Examiner*—Leonard E. Smith
*Attorney, Agent, or Firm*—Nydegger & Associates

[57] ABSTRACT

A drive mechanism for actuating the fingers of a peristaltic pump has a base, and a drive member reciprocally mounted on the base. A jointed arm is pivotally attached at one end to the drive member and at the other end to a fixed point on the base. A rotary cam actuator is mounted on the base to urge against the arm to reciprocate the drive member.

29 Claims, 3 Drawing Sheets

FLUID PUMP DRIVE MECHANISM

FIELD OF THE INVENTION

This invention pertains generally to a pumping mechanism. More specifically, the present invention pertains to reciprocating drive mechanisms which are useful for generating a cyclically variable driving force. The present invention is particularly, but not exclusively, useful as a pumping mechanism for a linear peristaltic pump.

BACKGROUND OF THE INVENTION

A number of pumps for infusion of medical solutions to patients have been developed over the years. Without exception, it is necessary and desirable that pumped medical solutions not enter into direct contact with the internal components of the pump. This is so either to prevent contamination of the solution, or to prevent corrosion of the pump caused by a medical solution.

One device which does not require direct contact between the internal mechanisms of the pump and the pumped fluid is the well-known peristaltic pump. A peristaltic pump is a type of pump which uses wave-like motion against the walls of a flexible tube that contains the fluid to be pumped in order to pump the fluid. As is well known, peristaltic pumps may be of two varieties: rotary or linear. Linear peristaltic pumps are preferred over rotary peristaltic pumps for certain applications because they possess certain advantages over rotary peristaltic pumps. In particular, some of the advantages associated with the linear type include operationally lower shear and tensile stresses imposed on the tubing which is used to convey the fluid. Also, there is less tendency toward spallation of the tubing's inner walls. Additionally, linear peristaltic pumps impose relatively lower forces on the tubing than do most rotary peristaltic pumps. This is important because the pumped fluid may be damaged when relatively high forces are imposed on the tubing.

Linear peristaltic pumps achieve these relative advantages by using reciprocating parts to provide peristaltic action against the tube to move the fluid through the tube. More specifically, linear pumps typically use a plurality of reciprocating fingers that are sequentially urged against the tube, which in turn causes sequential occlusion of adjacent segments of the tube in a wave-like action. Ideally, the speed with which the reciprocating fingers move toward the tube during a pump stroke is not constant. This is so because, as the tubing is squeezed, equal increments of finger motion produce progressively larger displacements of fluid. The ideal finger motion is therefore relatively rapid at the start of the stroke and then slower as the stroke progresses. It will be appreciated that the benefit of the ideal variable finger speed motion described above is to provide a uniform rate of fluid delivery over the stroke cycle.

Obtaining variable finger speed in linear peristaltic pumps, however, is not without its costs. This is so because the drive mechanism which actuates the fingers must account for a load which varies as finger speed varies. Conventional drive mechanisms have accounted for variable actuator load by simply imposing the variable load on the actuator motor. The skilled artisan will recognize that because the motor used in a drive mechanism must be sized to account for peak load, rather than average load, this method of allocating load variations requires the use of relatively large motors. Furthermore, it is generally true that when variable loads are imposed on motors, the useful life of the motors tends to be reduced. In addition, as is well known in the art, a motor that produces work at a variable rate does so less efficiently than a motor which is permitted to produce the same amount of work, but at a relatively constant rate.

It is therefore an object of the present invention to provide a drive mechanism for a linear peristaltic pump that results in variable pump finger speed over a stroke cycle. It is a further object of the present invention to provide a drive mechanism for a linear peristaltic pump which produces variable pump finger speed while maintaining a substantially constant torque (load) on the motor. It is yet another object of the present invention to provide a drive mechanism for a linear peristaltic pump that is relatively inexpensive to manufacture, easy to use, cost effective, and durable and reliable in its operation.

SUMMARY OF THE INVENTION

A novel reciprocal drive mechanism for actuating a finger of a linear peristaltic pump comprises a base and a drive member mounted for linear reciprocation on the base. The drive member is attached to the peristaltic finger and is pivotally attached to a jointed arm which comprises a pair of links. The first end of one link is pivotally attached to a fixed point on the base of the drive mechanism, while the second end of the first link is pinned to the first end of the second link. This connection establishes a joint between the two links which allows for a pivotal motion between the links. The second end of the second link is in turn pivotally attached to the drive member. A rotatable cam actuator is also mounted on the base of the drive mechanism to continuously urge against the joint of the arm. As the actuator urges against the joint, it reciprocates the drive member by moving the jointed arm between a first configuration, wherein the drive member is in an extended position, and a second configuration, wherein the drive member is in a withdrawn position.

In the preferred embodiment of the present invention, the jointed arm is sized and disposed against the tubing to be compressed such that the arm itself is never permitted to fully extend into a linear configuration, to prevent mechanically locking the arm. Thus, when the jointed arm is in its extended, but still angled configuration, the counter force of the fluid-filled tube against the drive member keeps the jointed arm in contact with the cam.

The novel features of this invention, as well as the invention itself, both as to its structure and its operation, will be best understood from the accompanying drawings, taken in conjunction with the accompanying description, in which similar reference characters refer to similar parts, and in which:

DETAILED DESCRIPTION OF THE PREFERRED EMBODIMENT

Figure 1:
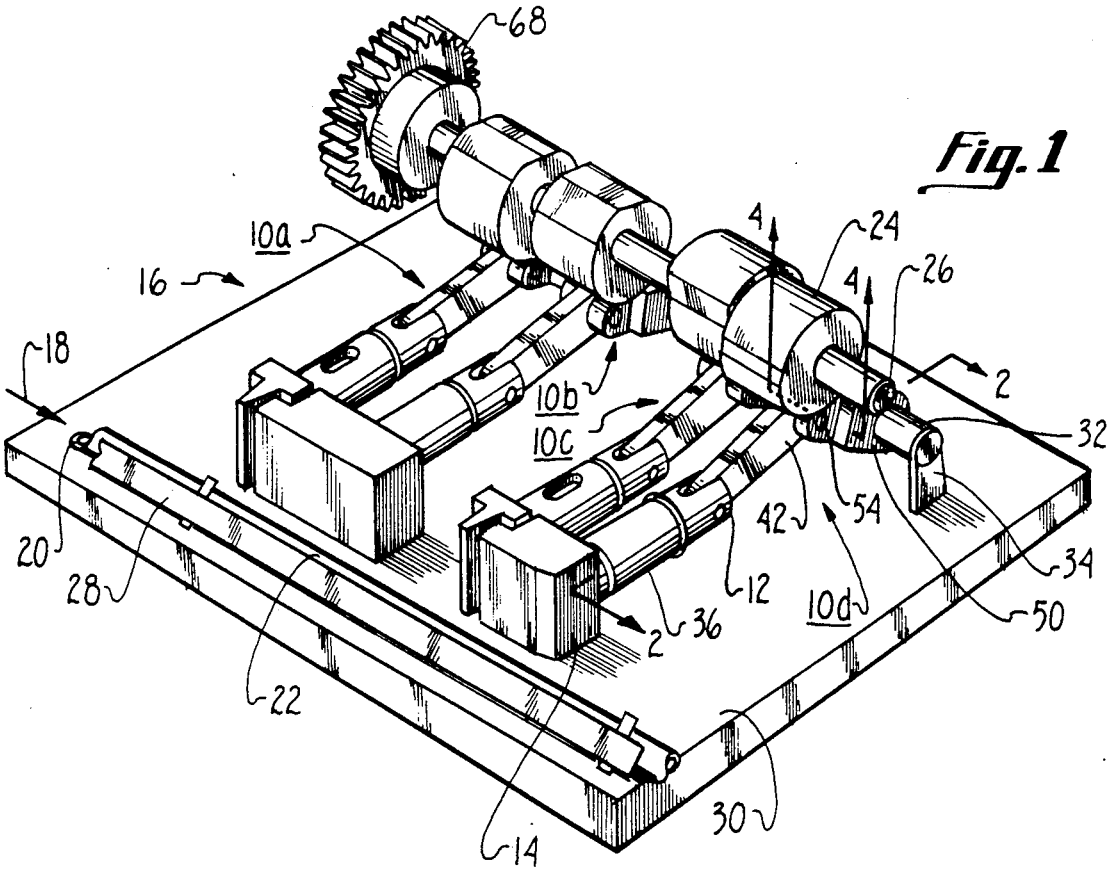
FIG. 1 is a perspective view of four pump drive mechanisms operating in conjunction with a four fingered linear peristaltic pump.

Referring now to FIG. 1, there is shown four pump drive mechanisms, generally designated 10*a–d*, respectively, shown in operative association with a four fingered peristaltic pump 16. The construction and operation of the particular linear peristalic pump 16 shown in FIG. 1 is fully described in U.S. patent application Ser. No. 419,193 entitled "Two Cycle Peristaltic Pump" which is assigned to the same assignee as the present invention. In the embodiment shown in FIG. 1, mechanisms 10*a* and 10*c* drive pinching fingers of the peristalic pump 16, while drive mechanisms 10*b* and 10*d* drive pumping fingers of the peristaltic pump 16. While the particular cam geometry of the individual mechanisms 10 may vary depending on whether the mechanism 10 is driving a pumping or pinching finger, as will be shortly disclosed, the configuration and operation of each mechanism 10 is in all essential respects the same, independent of the particular type of finger being driven.

Accordingly, for clarity of disclosure, the structure and operation of only the pump drive mechanism 10*d* will be discussed, but it will be understood that the following disclosure applies to all four pump drive mechanisms shown in FIG. 1. In particular, drive member 12 of pump drive mechanism 10 is shown attached to a finger 14 of a four-fingered linear peristaltic pump 16. It is to be understood, however, that pump drive mechanism 10*d* may be used in conjunction with many different types of linear peristaltic pumps, in addition to the pump 16 shown in FIG. 1. An appropriate fluid source (not shown), schematically designated by arrow 18, is shown connected in fluid communication with hollow resilient tube 20. Tube 20 is a conventional intravenous infusion-type tube of the type typically used in a hospital or medical environment, but could likewise be any type of flexible tubing, such as rubber. FIG. 1 also shows a portion 22 of flexible tube 20 which is mounted on platen 28 of pump base 30, for pumping fluid through tube 20.

Further shown in FIG. 1 is a non-circular cam 24 of drive mechanism 10*d*, which is mounted on drive shaft 26. It will be appreciated by the skilled artisan that for peristaltic pumps having a plurality of drive mechanisms 10, the initial orientations of the associated cams 24 about drive shaft 26 establishes the relative timing for the occlusion sequencing of the associated fingers 14. The importance of this timing, for the particular peristaltic pump 16 shown, is more fully explained in the pending U.S. patent application Ser. No. 419,193 cited above. Importantly, the degree to which the profile of a particular cam 24 varies from purely circular depends on the type and size of finger, pumping or pinching, with which cam 24 is associated. For example, the profile of a cam 24 which drives a pinching finger is selected to provide a maximum mechanical advantage to the mechanism 10 with which the particular cam 24 is associated. On the other hand, the profile of a cam 24 which drives a pumping finger is selected to establish equal increments of fluid displacement for equal increments of rotation of the mechanism 10 drive motor (not shown). It is to be understood that when a cam 24 has such a profile, it so happens that the torque imposed on the mechanism 10 drive motor is also relatively constant throughout the mechanism 10 cycle.

Figure 2:
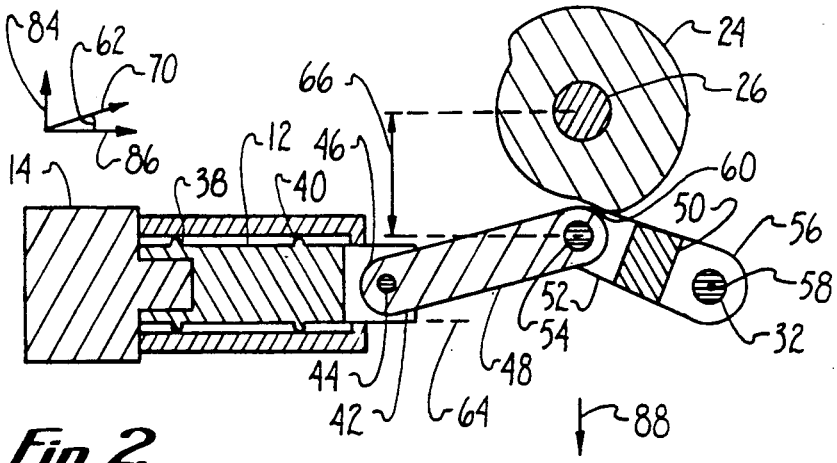
FIG. 2 is a side cross-sectional view of the pump drive mechanism as seen along the line 2—2 in FIG. 1, with the pump drive mechanism in its fully withdrawn position.
Figure 3:
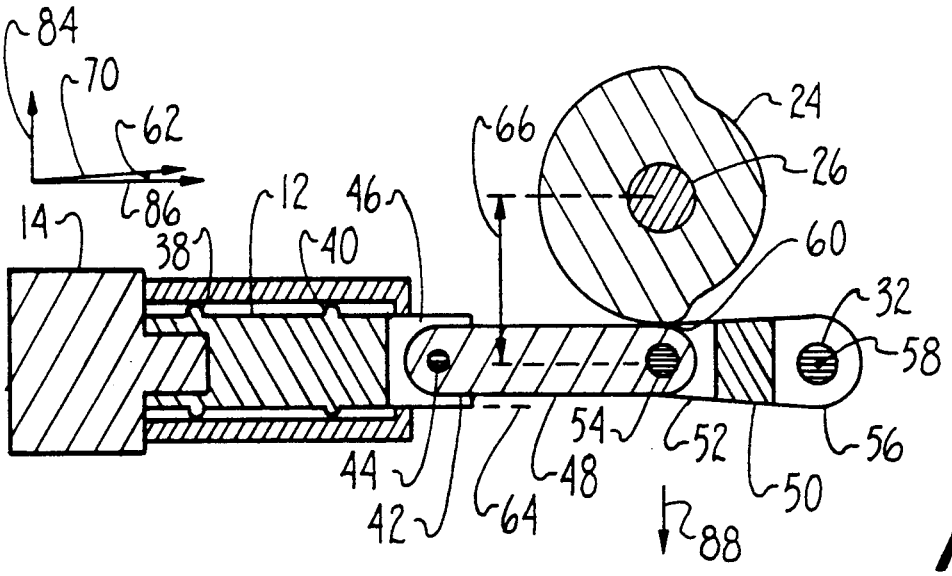
FIG. 3 is a side cross-sectional view of the pump drive mechanism as seen along the line 2—2 in FIG. 1, with the pump drive mechanism in its fully extended position.

As seen in FIGS. 2 and 3, cam 24 is fixedly mounted on drive shaft 26, which in turn is connected, in the preferred embodiment, to any suitable motor (not shown) through a connecting mechanism, such as gear 68. Alternatively, each cam may be mounted on a separate drive shaft which is independently powered by its own individual motor. The entire assembly shown in FIG. 1, consisting of pump 16, pump drive mechanisms 10, and tube 20, is mounted on pump base 30. Moreover, it is shown in FIG. 1 that a pivot shaft 32 is mounted at one end on base 30 at bearing flange 34 for operation to be subsequently disclosed. Likewise, pivot shaft 32 is mounted at its other end on base 30 on another flange (not shown). Similarly, it is to be appreciated that drive shaft 26 is rotationally mounted on base 30. A housing (not shown) may be provided to cover pump base 30 and completely enclose the assembly described above.

The details of pump drive mechanism 10 may be best described in reference to FIG. 2. There, it is shown that drive member 12 of pump drive mechanism 10 is fixedly attached to finger 14 of peristaltic pump 16 by any suitable means. As disclosed above, a peristaltic pump 16 having a plurality of fingers 14 requires a plurality of pump drive mechanisms 10. Accordingly, the drive members 12 of the pump drive mechanisms 10 may be of different lengths, one from the other, to accommodate differences in the travel distances of the various fingers 14. It is to be understood, however, that the above method of accounting for differences in finger 14 travel distances is but one method that may be used. Also shown in FIG. 2 is a fixed sleeve 36 which surrounds and contacts drive member 12 around internal washers 38 and 40, which are fixedly mounted in turn around drive member 12 by any suitable means. Likewise, sleeve 36 is fixedly mounted to base 30 by any means well known in the art. Thus, it will be appreciated that when mounted as described above, sleeve 36 constrains drive member 12 to substantially linear, piston-like motion within sleeve 36.

It is also to be understood that the materials selected for washers 38 and 40, or for sleeve 36, or both, should provide for self-lubrication between sleeve 36 and washers 38 and 40 which are in moving contact with sleeve 36. As shown in FIG. 2, an elongated drive link 42 is pivotably connected to end 46 of drive member 12 at link pin 44. Link pin 44 extends through drive member 12 and drive link 42 and is held in position by any means well known in the art, such as by press fitting link pin 44 into and through drive shaft 26 and drive member 12. Drive link 42 is in turn pivotably attached at its other end 48 to end 52 of pivot link 50, again by any suitable means which allows for pivotal motion between links 42 and 50. In the embodiment shown, this pivotal attachment is provided for by pivot pin 54, which pivotably interconnects links 42 and 50.

Still referring to FIG. 2, it is shown that end 56 of pivot link 50 is connected to pivot shaft 32, which is mounted or base 30 substantially perpendicularly to the motion of travel of drive member 12 and which extends through pivot link 50. As described above, pivot shaft 32 is fixedly mounted to base 30. Thus, it will be appreciated that pivot link 50 pivots about the fixed longitudinal axis which extends through the center 58 of pivot shaft 32.

As shown in FIG. 2, cam 24 is mounted in rotational contact with links 42 and 50 at a jointed elbow 60, which is formed between links 42 and 50 by the pivotal interconnection of links 42 and 50 described above. Cam 24 is in turn fixedly mounted to drive shaft 26 by any means well known in the art. It will be appreciated that because cam 24 is in rotational contact with elbow 60, as more fully disclosed below, the materials of cam 24 or elbow 60, or both, should be selected to provide for self-lubrication of the wear surfaces on cam 24 and jointed elbow 60. As further shown in FIGS. 2 and 3, cam 24 is shaped so that the distance 66 between the center of drive shaft 26 and the center of pivot pin 54 is varied as cam 24 rotates. It will be appreciated that as distance 66 varies, the angle 62 between drive link 42 and the plane 64 of drive member 12 reciprocating motion is thereby varied. Stated differently, it will be understood that because cam 24 is shaped in a non-circular profile, as cam 24 is rotated against elbow 60, the angle 62 is varied between a maximum and a minimum value. The maximum value of angle 62 corresponds to the fully withdrawn position of drive member 12 shown in FIG. 2, while the minimum value of angle 62 corresponds to the fully extended position of drive member 12 shown in FIG. 3. The maximum and minimum values of angle 62 thus depend on the relative lengths of drive member 12, drive link 42, and pivot link 50, as well as the degree of eccentricity of cam 24. The dimensions of drive member 12 and links 42 and 50, and the degree of eccentricity of cam 24, are in turn designed to provide a mechanical advantage to the motor which rotates drive shaft 26 (and therefore cam 24) as more fully disclosed below.

For the particular embodiment shown, angle 62 varies between a minimum of six degrees (6° ) and a maximum of twelve and thirty-five hundredths degrees (12.35° ), for drive mechanisms 10 which drive the pinching fingers of the particular peristaltic pump 16 shown. In contrast, for drive mechanisms 10 which drive the pumping fingers of the pump 16 shown, angle 62 may vary between six degrees (6° ) and fourteen degrees (14° ). In addition to the above considerations, the minimum value of angle 62 must remain large enough to ensure that the link system described above does not mechanically lock when in the fully extended position shown in FIG. 3. Specifically, angle 62 must remain large enough to ensure that the elastomeric force of fluid-filled tube portion 22 against finger 14, caused by the tendency of resilient tube portion 22 to recoil to its non-occluded shape when filled with fluid is sufficient to keep elbow 60 in contact with cam 24. That is, tube portion 22 provides a constant force against finger 14 in the direction of arrow 70. This force is transmitted, in turn, through the linkages described above to the translationally fixed end 56 of pivot pin 54. Thus, when the angle 62 remains greater than a predetermined minimum value, the elastomeric force of resilient tube portion 22 is sufficient to keep elbow 60 in contact with cam 24 as cam 24 is rotated through its eccentric cycle. This in turn substantially prevents mechanical lock of drive mechanism 10.

Figure 5:
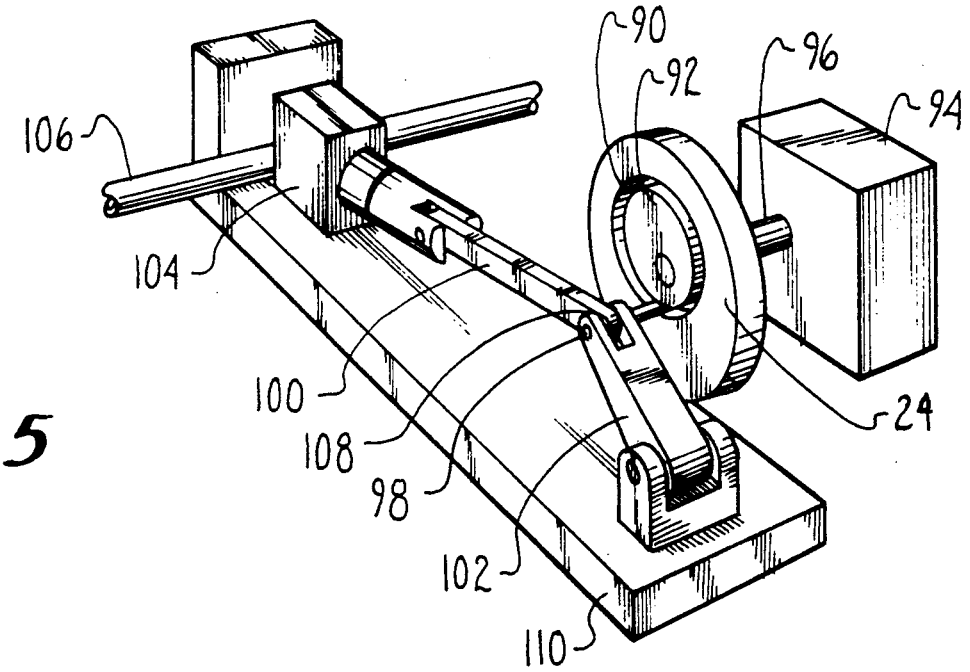
FIG. 5 is a perspective view of an alternate embodiment of the drive mechanism cam arrangement.

On the other hand, it is possible that some applications of mechanism 10 could establish an angle 62 of zero or even a negative value, relative to FIGS. 2 and 3. As the skilled artisan will appreciate, such an embodiment would require pinning cam 24 to elbow 60 in the well-known Geneva Drive geometry so that cam 24 could both push and pull elbow 60 through a zero angle 62. An example of such an arrangement is shown in FIG. 5. There, a cam 88 is shown which has an eccentric groove 90 formed on cam face 92. Cam 88 is shown attached to a motor 94 via shaft 96. As shown in FIG. 5, joint pin 98, which pivotally connects drive link 100 with pivot link 102, extends into eccentric groove 90. Thus, as cam 88 is rotated by motor 94, pin 98 follows the path of eccentric groove 90 to cause reciprocation of drive member 104, which accordingly squeezes resilient tube 106. Accordingly, cam 88 can push and then pull joint 108 through a zero angle relative to base 110 because joint pin 98 is constrained to remain within the rotating eccentric groove 90.

Figure 4:
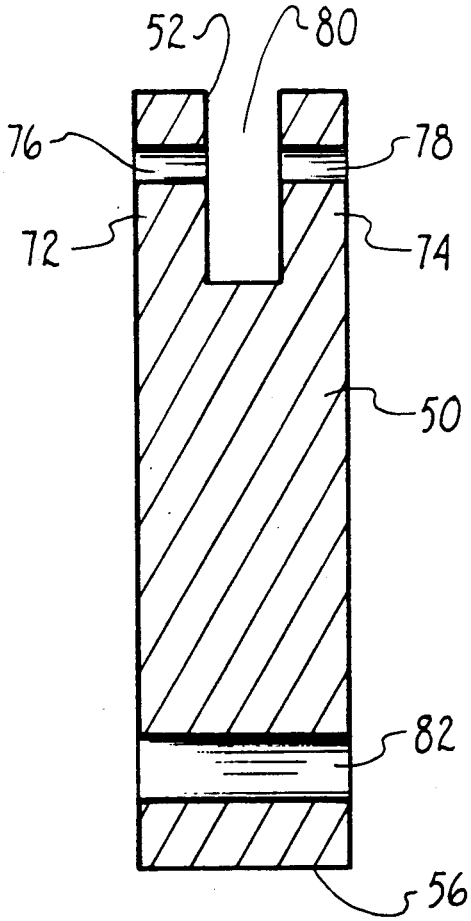
FIG. 4 is a top view of the pivot link of the pump drive mechanism as seen along the line 4—4 in FIG. 1, with the cam and drive shaft removed for clarity.

FIG. 4 shows the details of the construction of pivot link 50. There, it is seen that the pivot link 50 of the preferred embodiment comprises arms 72 and 74, which are formed at end 52 with pin passages 76 and 78, respectively. Pin passages 76 and 78 receive a link pin, such as link pin 44. Arms 72 and 74 also form slot 80 for pivotably receiving end 98 of drive link 42 as described above. Additionally, pivot link 50 is formed at its opposite end 56 with a pivot pin passage 82, for receiving pivot pin 54 as previously described.

OPERATION

The operation of pump drive mechanism **10*d* is best seen with cross reference to FIGS. 1 and 2. Cam 24 of drive mechanism 10 is shown disposed on drive shaft 26, with the respective eccentricities of all four cams 24 oriented relative to drive shaft 26 to establish the finger 14 sequencing necessary for proper operation of peristaltic pump 16. When gear 68 is engaged by a suitable drive motor, drive shaft 26 is rotated and in turn rotates cam 24. As cam 24 rotates, it urges against its respective elbow 60 to vary the angle 62 between the maximum and minimum values of angle 62, as disclosed above. The resulting angular motion of links 42 and 50 is translated into linear motion of drive member 12. This translation is effected by the constraint imposed by sleeve 36 on drive member 12. Specifically, sleeve 36, in cooperation with the constraint imposed on pivot link 50 by its fixed end 56, constrains drive member 12 to substantially linear motion. Elbow 60 is kept in contact with cam 24 by the elastomeric force of resilient fluid-filled tube portion 22 acting against cam 24** through the system of links and disclosed above.

It will be appreciated from the foregoing discussion that when links 42 and 50 and cam 24 are properly sized in relation to one another, the pump drive mechanism 10 motor is subjected to a relatively constant torque throughout the cycle of drive mechanism 10. This is so because the motor of pump drive mechanism 10 must overcome the effect of the normal component (represented by arrow 84) of the counterforce (represented by arrow 70) that is induced by resilient fluid-filled tube portion 22 as it is compressed. In particular, in reference to FIGS. 2 and 3, the counterforce 70 induced by the compressed IV tubing 22 is transmitted by the link system to elbow 60. As previously stated, force 70 may be broken down into normal components, represented by arrows 84 and 86. As is well known, the normal component 84 of the tube 22 counterforce 70 depends directly on the magnitude of the counterforce 70 and the sine of the angle 62. Importantly, the magnitude of the counterforce 70 increases with increasing tube 22 compression, which is in turn caused by mechanism 10 approaching its extended position shown in FIG. 3. As the magnitude of the counterforce 70 increases, however, the sine of the angle 62 decreases, as disclosed above. It will be understood, therefore, that drive mechanism 10 provides a mechanical advantage which is inversely related to the sine of angle 62.

Thus, as the counterforce 70 increases with increasing compression of tube 22, the mechanical advantage provided by drive mechanism 10 as described above counteracts the increase. Similarly, as drive mechanism 10 approaches its withdrawn position, compression of tube 22 decreases and the magnitude of the counterforce 70 correspondingly decreases. As disclosed above, however, the mechanical advantage provided by drive mechanism 10 decreases as angle 62 increases. Accordingly, the normal component 84 of the counterforce 70 remains relatively constant throughout the cycle of drive mechanism 10. It will now be understood that the motor of drive mechanism 10 must accordingly overcome a relatively constant counter torque, viz., the normal component 84 of the counterforce 70 which is induced by elastomeric fluid-filled tube portion 22.

When the structure of drive mechanism 10 is configured as disclosed above, the mechanical advantage provided by mechanism 10 is sufficient to allow force 88 to marginally overcome force 84 and thereby urge finger 14 from its withdrawn position to its extended position. On the other hand, when finger 14 reaches its extended position, the mechanical advantage of drive mechanism 10 permits force 84 to marginally overcome force 88 so that elastomeric tube portion 22 urges finger 14 from its extended position back to its withdrawn position. It is to be understood, however, that because component 84 is relatively constant, the force 88 which must be provided by cam 24 is also relatively constant.

It will be further appreciated that while the torque required to reciprocate drive member 12 is relatively constant throughout the drive mechanism 10 cycle, as described above, the motion of drive member 12 (and hence finger 14) is not. As suggested by the disclosure above, translation of rotary motion of the cam 24 into linear motion of drive member 12 is not itself a linear function, but is rather a sinusoidal function. Therefore, linear motion of drive member 12 toward tube portion 22 will be relatively rapid at first (i.e., at that point of the drive mechanism 10 cycle shown in FIG. 2), subsequently slowing down as drive member 12 approaches its fully extended position (shown in FIG. 3).

While the particular fluid pump drive mechanism as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

What is claimed:

1. An apparatus for establishing a substantially nonpulsitile flow of fluid through a resilient tube, which comprises:

means for urging against said tube with a variable force to constrict said tube and establish a substantially constant fluid flow therethrough; and means for converting a substantially constant force into said variable force.

2. An apparatus for establishing a substantially nonpulsitile flow of fluid through a resilient tube as recited in claim 1 wherein said urging means comprises a base and an elongated rigid drive member mounted on said base for reciprocal motion.

3. An apparatus for establishing a substantially nonpulsitile flow of fluid through a resilient tube as recited in claim 2 wherein said converting means comprises a profiled cam and an elongated arm, said arm having a first end pivotally attached to said drive member, a second end pivotally attached to said base, and a joint intermediate said ends, said cam being rotatably mounted on said base to urge against said joint.

4. A reciprocal drive mechanism for pumping fluid through a resilient tube which comprises:

a base;

a means for holding said tube on said base;

a drive member reciprocally mounted on said base for urging against said tube to constrict said tube and regulate fluid flow through said tube;

a set point fixedly mounted on said base;

a joined arm having a first end pivotally attached to said set point and a second end pivotally attached to said drive member; and an actuator mounted on said base for urging against said arm to reciprocate said drive member.

5. A reciprocal drive mechanism as recited in claim 4 wherein said actuator is a rotatable cam.

6. A reciprocal drive mechanism as recited in claim 4 wherein said drive member is mounted on said base for substantially linear motion.

7. A reciprocal drive mechanism as recited in claim 6 wherein said set point is aligned with said drive member.

8. A reciprocal drive mechanism as recited in claim 4 wherein said jointed arm comprises a first link and a second link pinned to said first link to establish a joint between said first end and said second end.

9. A reciprocal drive mechanism as recited in claim 8 wherein said actuator is positioned on said base to urge against said joint.

10. A reciprocal drive mechanism as recited in claim 8 wherein said joint is approximately intermediate said first end and said second end.

11. A mechanism for reciprocating a drive member against a resilient tube which comprises:

a base for reciprocally supporting said drive member;

a means for holding said tube on said base between said base and said drive member;

a jointed arm having a first end pivotally attached to said base and a second end pivotally attached to said drive member; and an actuator mounted on said base for urging against said jointed arm to reciprocate said drive member from an extended position wherein said tube is compressed to a withdrawn position wherein said tube is open.

12. A mechanism for reciprocating a drive member as recited in claim 11 wherein said first end and said second end are colinearly aligned.

13. A mechanism for reciprocating a drive member as recited in claim 11 wherein said jointed arm comprises a first link and a second link pinned to said first link to establish a joint between said first end and said second end.

14. A mechanism for reciprocating a drive member as recited in claim 13 wherein said actuator is positioned on said base to urge against said joint.

15. A mechanism for reciprocating a drive member as recited in claim 13 wherein said joint is approximately intermediate said first end and said second end.

16. A mechanism for reciprocating a drive member as recited in claim 13 wherein said actuator is a rotatable cam.

17. A mechanism for reciprocating a drive member on a base against a resilient tube which comprises:

a means for holding said tube on said base;

a jointed arm connecting said drive member at a first end to said base at a second end, said arm having a first link and a second link pinned to said first link to establish a joint between said first end and said second end, said arm configurable between a first configuration wherein said drive member is in an extended position and said tube is constricted and a second configuration wherein said drive member is in a withdrawn position and said tube is open; and an actuator mounted on said base and connected with said arm to alternatingly move said arm between said first and second configurations.

18. A mechanism for reciprocating a drive member on a base as recited in claim 17 wherein said actuator is positioned on said base to urge against said joint.

19. A mechanism for reciprocating a drive member on a base as recited in claim 17 wherein said joint is approximately intermediate said first end and said second end.

20. A mechanism for reciprocating a drive member on a base as recited in claim 17 wherein said actuator is a rotatable cam.

21. A mechanism for reciprocating a drive member on a base as recited in claim 17 wherein said jointed arm in said first configuration is substantially straight.

22. A reciprocal drive mechanism actuated by a motor for pumping fluid through a resilient tube which comprises:

a base for supporting said tube and said motor;

a drive member reciprocally mounted on said base for contacting said tube to urge fluid through said tube;

jointed means pivotably attached to said drive member and said base for transforming rotating motion of said motor into reciprocal motion of said drive member; and cam means operably connected between said motor and said jointed means for establishing a substantially constant torque on said motor during equal increments of rotation of said motor and for establishing substantially equal increments of volumetric fluid flow through said tube for said equal increments of rotation of said motor.

23. A reciprocal drive mechanism actuated by a motor for pumping fluid through a resilient tube as recited in claim 22 wherein said cam means comprises a non-circular cam rotatably mounted on said base.

24. A reciprocal drive mechanism actuated by a motor for pumping fluid through a resilient tube as recited in claim 22 wherein said drive member is mounted on said base for substantially linear motion.

25. A reciprocal drive mechanism actuated by a motor for pumping fluid through a resilient tube as recited in claim 22 wherein said jointed means comprises a jointed arm having a first end pivotally attached to said base and a second end pivotally attached to said drive member.

26. A reciprocal drive mechanism actuated by a motor for pumping fluid through a resilient tube as recited in claim 25 wherein said first end of said arm is attached to said base at a point in alignment with said drive member.

27. A reciprocal drive mechanism actuated by a motor for pumping fluid through a resilient tube as recited in claim 25 wherein said jointed arm comprises a first link and a second link pinned to said first link to establish a joint between said first end and said second end.

28. A reciprocal drive mechanism actuated by a motor for pumping fluid through a resilient tube as recited in claim 27 wherein said cam means is positioned on said base to urge against said joint.

29. A reciprocal drive mechanism actuated by a motor for pumping fluid through a resilient tube as recited in claim 27 wherein said joint is approximately intermediate said first end and said second end.

* * * * *